US008251252B2

(12) United States Patent
Giraud

(10) Patent No.: US 8,251,252 B2
(45) Date of Patent: Aug. 28, 2012

(54) TWIST AND LIFT CLOSURE FOR CONTAINERS

(75) Inventor: Jean Pierre Giraud, Paris (FR)

(73) Assignee: CSP Technologies, Inc., Amsterdam, NY (US)

( * ) Notice: Subject to any disclaimer, the term of this patent is extended or adjusted under 35 U.S.C. 154(b) by 1511 days.

(21) Appl. No.: 11/683,266

(22) Filed: Mar. 7, 2007

(65) Prior Publication Data

US 2007/0228061 A1 Oct. 4, 2007

Related U.S. Application Data

(60) Provisional application No. 60/779,934, filed on Mar. 7, 2006.

(51) Int. Cl.
*B65D 43/22* (2006.01)

(52) U.S. Cl. ..... 220/835; 220/315; 220/259.1; 215/277; 215/24

(58) Field of Classification Search ..... 220/259.1, 220/259.2, 817, 835, 839, 833, 834, 315, 220/326; 215/235, 237, 273, 277, 225, 244, 215/245

See application file for complete search history.

(56) References Cited

U.S. PATENT DOCUMENTS 3,623,622 A * 11/1971 Sullivan ..... 215/213
3,703,974 A 11/1972 Boxer et al.
5,593,054 A 1/1997 Glynn
7,040,499 B1 * 5/2006 Reif ..... 220/291
2005/0029266 A1 * 2/2005 Ziegenhorn et al. ..... 220/256.1

FOREIGN PATENT DOCUMENTS

JP 58-194151 12/1983
JP 9150849 A 6/1997

OTHER PUBLICATIONS

International Preliminary Report on Patentability corresponding to International Application Serial No. PCT/US2007/005951, mailed Sep. 18, 2008, 6 pages.
International Search Report (PCT/US07/05951) mailed Oct. 3, 2007, 4 pp.
Japanese Patent Office, Notice of Reason(s) for Refusal, in Patent application No. 2008-558402, dated Jan. 31, 2002.

* cited by examiner

*Primary Examiner* — Anthony Stashick
*Assistant Examiner* — James N Smalley
(74) *Attorney, Agent, or Firm* — McAndrews, Held & Malloy, Ltd.

(57) ABSTRACT

A child-resistant lift-top container is disclosed. The container includes a vessel, a lift-off inner cap and an outer locking cap. The outer locking cap engages the lift-off inner cap and is rotatable about the inner cap. The vessel includes a generally downwardly-facing abutment that engages an upwardly-facing abutment on the locking cap to lock the container and prevent the lift-off inner cap from opening. The container is opened by rotating the outer locking cap to disengage the abutments, permitting the lift-off inner cap to be lifted to open the container. The outer locking cap includes at least one spring that engages a spring-engaging surface on the vessel as the outer locking cap is rotated to assist in disengaging the abutments and to allow the outer locking cap to return to its closed and locked position.

18 Claims, 11 Drawing Sheets

TWIST AND LIFT CLOSURE FOR CONTAINERS

RELATED APPLICATIONS

This patent application makes reference to, claims priority to and claims benefit from U.S. Provisional Patent Application Ser. No. 60/779,934 filed on Mar. 7, 2006.

FIELD OF THE INVENTION

The present technology relates to child-resistant safety caps and containers with such caps, more particularly a container including a twist-and-lift child resistant closure that is useful for flip-top containers.

BACKGROUND OF THE INVENTION

There is an increasing awareness of the need to protect children from inadvertently gaining access to medications, especially prescribed medications. Sometimes, ingestion of only one or two pills of a prescribed medication will prove fatal to a child. Moreover, there is an increasing awareness of the necessity to provide containers for prescribed medications that are readily and easily opened by a person of responsible age, that is, any person having the cognitive ability to understand the instructions for opening a pill container, which requires certain manipulation and manual dexterity. Such persons are assumed, as well, to have the ability to understand that the act of opening a pill container to gain access to the prescribed medication is a deliberate action, and is only undertaken when there is a necessity to attain access to the prescribed medication in the pill container.

There are several conventional, so-called, "childproof" or "child-resistant" pill containers and bottles in the market, which are generally employed by dispensing pharmacists for use in filling prescriptions, where the prescription requires that the pharmacist dispense one or more of a plurality of pills, tablets, gel-caps, capsules, or the like, or a quantity of a liquid medicine. For example, the container may include a "push-and-turn" closure for pill containers, or an "arrow-alignment" closure for pill containers.

The "push-and-turn" system for pill containers conventionally refers to a system in which the closure or cap for the pill container must be pushed axially downwardly and rotated at the same time to open the container. The "arrow alignment" system for pill containers conventionally refers to a system in which an arrow on the closure or cap must be aligned with an arrow on the pill container, such as one which is embossed on the container, in order to open the container. However, these containers are often complicated for adults to use.

Conventional container assemblies, whether or not of the type where the cap or closure is tethered to the container, may have a fixed protrusion (also referred to as a "thumb tab") attached to the cap that is configured to assist in the opening of the cap. More typically, this fixed protrusion is opposite the hinge, and thus, acts as a lever to allow the intended user to open the container when a sufficient force is applied under the fixed protrusion.

However, these containers are easily opened by a child.

Therefore an improved container and closure assembly which is child resistant, yet easily opened by an adult, would be useful.

SUMMARY OF THE INVENTION

One aspect of the present technology is a child-resistant lift-top container including a vessel, and a closure system comprising a lift-off cap and a lock.

The vessel has a mouth defined by a rim. The vessel has a margin lying outside the rim, and a generally downward-facing abutment projecting laterally from the margin. The cap has a seating member sized and configured to seat on the rim.

The lock engages the cap and is rotatable with respect to the cap about an axis that is generally perpendicular to the rim when the cap is seated on the rim. The lock includes an upward-facing abutment normally biased to engage the downward-facing abutment of the vessel. This engagement prevents the cap from being lifted off. The abutments are disengaged by rotating the lock against the bias, permitting the cap to be lifted to open the container.

The subsidiary features shown or described in the present drawings or specification are each intended to be claimed, independently or in any combination.

While the presently described technology will be described in connection with one or more preferred embodiments, it will be understood by those skilled in the art that the present technology is not limited to those embodiments. On the contrary, the presently described technology includes all alternatives, modifications, and equivalents as may be included within the spirit and scope of the appended claims.

DETAILED DESCRIPTION OF THE INVENTION

The closure assembly of the present technology comprises two components, (1) a rotating outer cap or lock and (2) an inner flip-top cap.

The outer locking cap or lock is preferably snapped on to the inner flip-top cap. The outer cap engages a flange feature that is located along the circumference of the inner cap. When engaged, the outer cap can rotate on the stationary, non-rotatable flip-top inner cap. In the closed position a generally downward-facing lug or abutment, located on the container body, engages a slot in the outer cap having a generally upward-facing abutment, preventing the flip-top from opening.

To open the closure, a user rotates the outer cap or lock about the inner cap so that the slot in the outer cap is positioned away from the lug on the container body. The user keeps the outer cap in the rotated position and then lifts up on the cap. The inner flip-top cap opens. When the user releases the cap, the outer cap returns to its original (closed position) with a spring-like mechanism.

Specific details of alternative embodiments of the closure system of the present technology will now be discussed with reference to the drawings.

Figure 1:
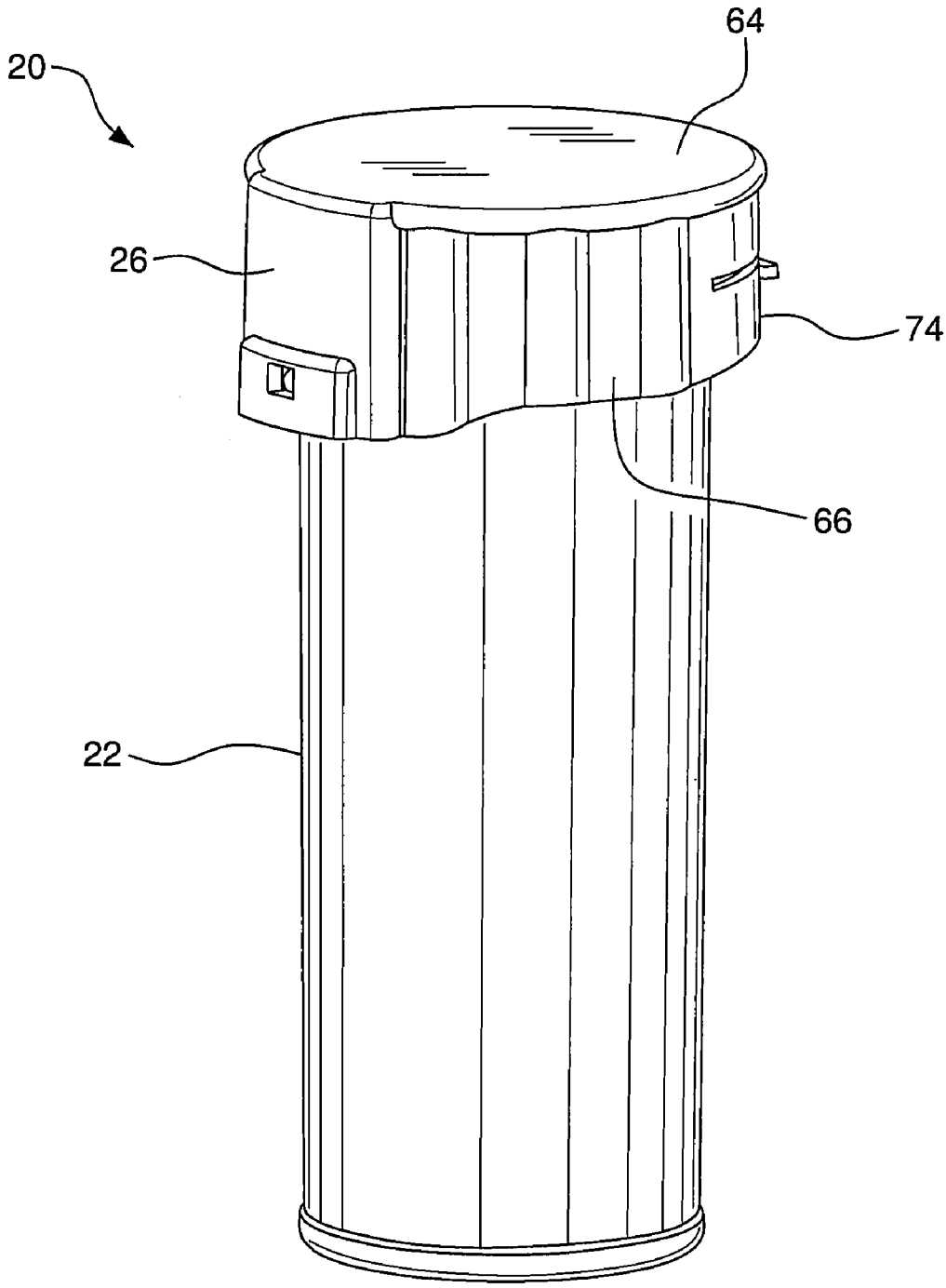
FIG. 1 is a perspective view of the vessel, cap, and lock assembly of an embodiment of the invention, when closed and locked.
Figure 2:
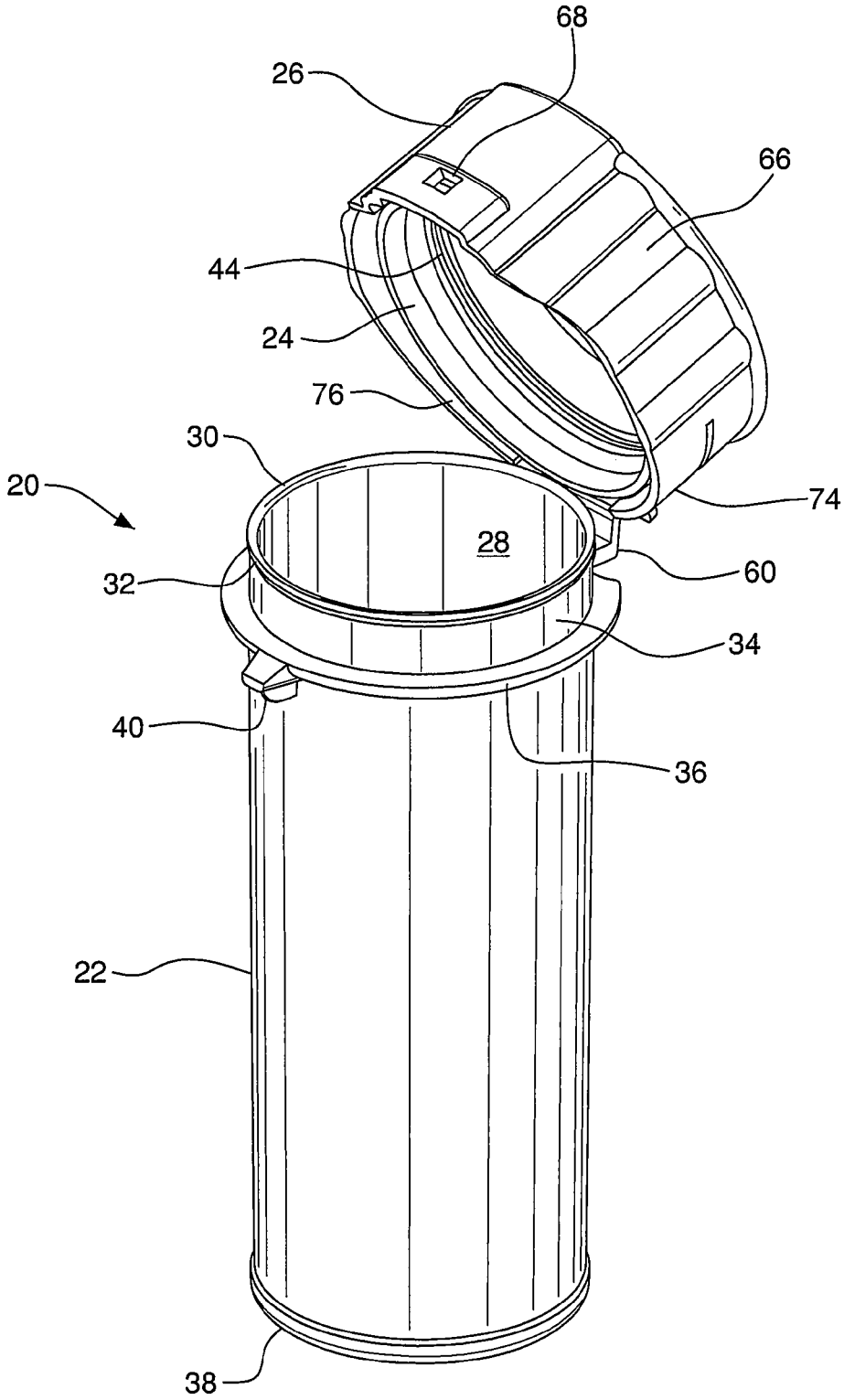
FIG. 2 is a view similar to FIG. 1, but showing the assembly with its cap unseated and opened.

Referring to the drawings, FIGS. 1-7 show an embodiment of a container 20, useful as a pill bottle, for example. Referring first to FIG. 2 in particular, the container 20 comprises a vessel 22, a lift-off cap 24, and an outer cap or lock 26. The vessel 22 is generally straight-walled and has an interior portion 28 accessed through a mouth 30 defined by a peripheral beaded rim 32. The vessel 22 has a margin 34 lying outside the rim and also, in this embodiment, extending below a flange 36. The "margin" is broadly defined to include any exterior portion of the vessel above its base 38. The flange 36 functions to prevent the lift-off cap from being accidentally opened by an upward force that could impact the container during shipping or if the container were accidentally dropped. If the container is bumped or dropped, the flange prevents an upward force from being directed on to the lift-off cap.

The vessel 22 has a generally downward-facing abutment 40 projecting laterally from the margin 34. "Downward-facing" is broadly defined in this context to mean facing approximately opposite the direction in which the cap 24 is lifted. "Downward facing" simply means that the abutment 40 does not face horizontally or upward, when the rim 32 is generally horizontal and positioned at the top. The abutment 40 can face directly downward or obliquely downward.

Figure 4:
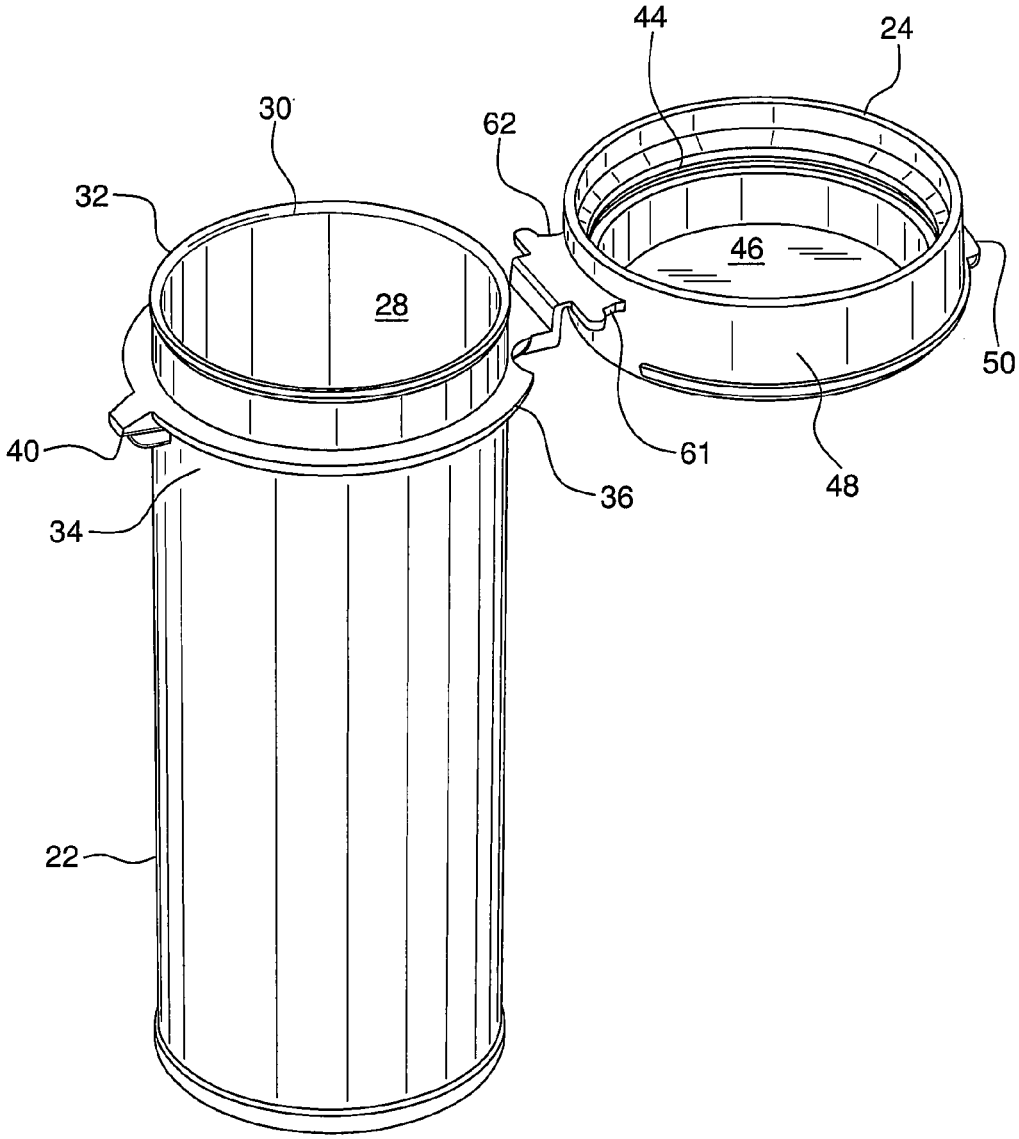
FIG. 4 is a view of the vessel and cap assembly of the embodiment of FIG. 1, with the lock removed to show underlying structure.
Figure 5:
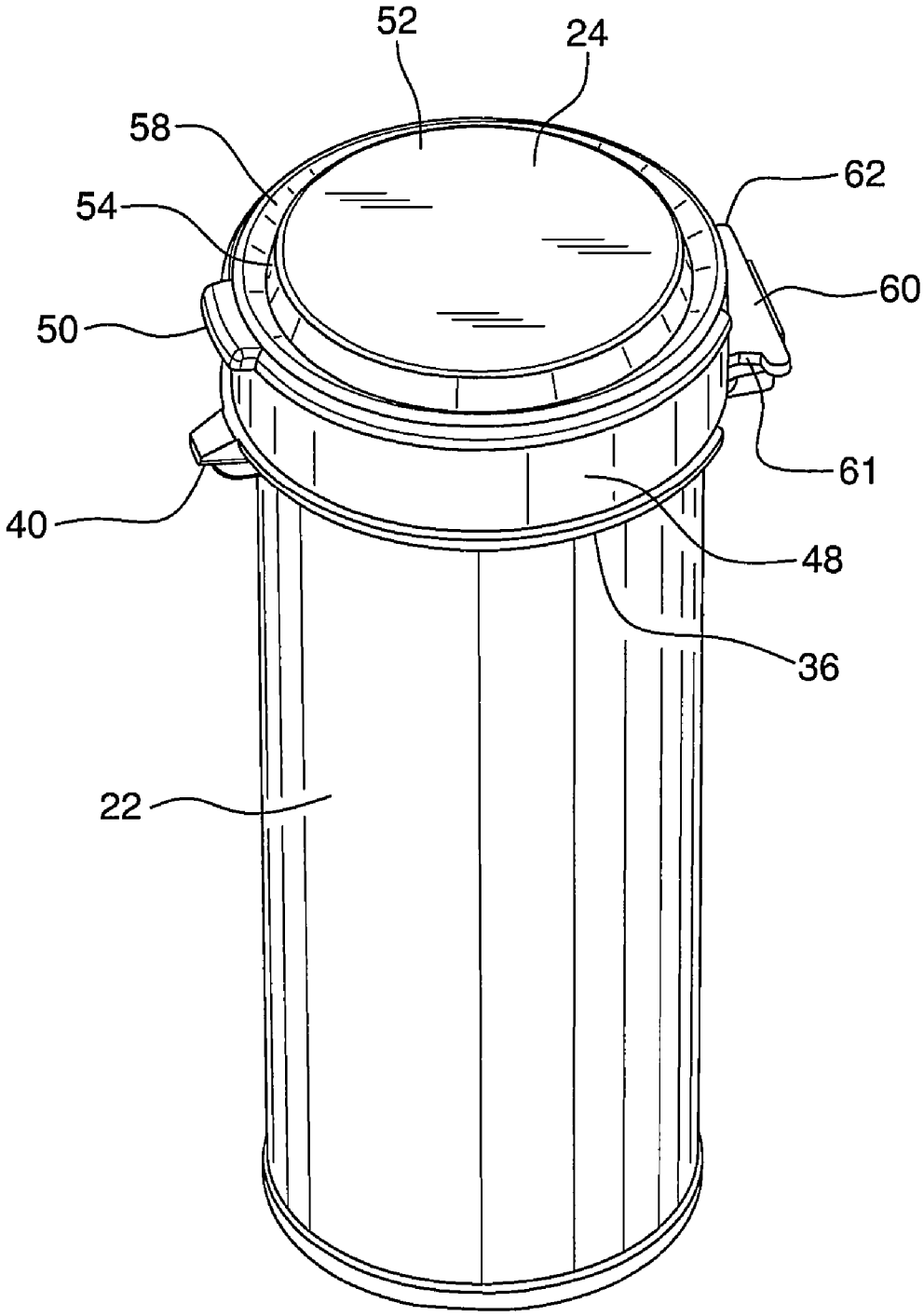
FIG. 5 is a view similar to FIG. 4, but showing the cap seated on the vessel.

Now referring to FIGS. 4 and 5, the lift-off cap 24 is described in more detail. The cap 24 has a seating member 44 which, in the illustrated embodiment, is a groove, sized and configured to seat on the rim 32 of the vessel. The rim 32 of this embodiment is beaded to seat in the groove 44 and form a seal. The rim 32 and groove 44 provide an interference fit. In other embodiments, a seal need not be formed, nor is an interference fit essential in some instances, depending on the contents intended for the container 20. In the illustrated embodiment, the cap 24 has a web 46, a skirt 48 depending from the web 46, and a thumb tab 50. The thumb tab 50 is provided so the same cap 24 and vessel 22 assembly, illustrated in FIG. 5, can function as a flip-top container without installing the lock 26, as when certain containers do not need to be childproof.

Referring in particular to FIG. 5, the cap 24 also has a roughly mushroom-shaped crown 52. The crown 52 has a wider portion or head defining a pivot flange 54 to receive and cooperate with the lock 26, and a narrower neck 56 beneath the head. A pivot groove 58 is defined under the pivot flange 54 and radially outside the neck 56.

In the illustrated embodiment, the vessel 22 is joined to the lift-off cap 24 by a hinge 60, which may be, for example, an integral hinge. In the illustrated embodiment, the hinge 60 is formed integrally with the vessel 22 and the lift-off cap 24 in a single mold. These parts can alternatively be fabricated as more than one part and assembled. A hinge 60 also is not essential, and could be omitted, or could be replaced by a tether or other capturing arrangement, without limitation. In this embodiment, the hinge 60 also defines spring abutments 61 and 62.

Figure 3:
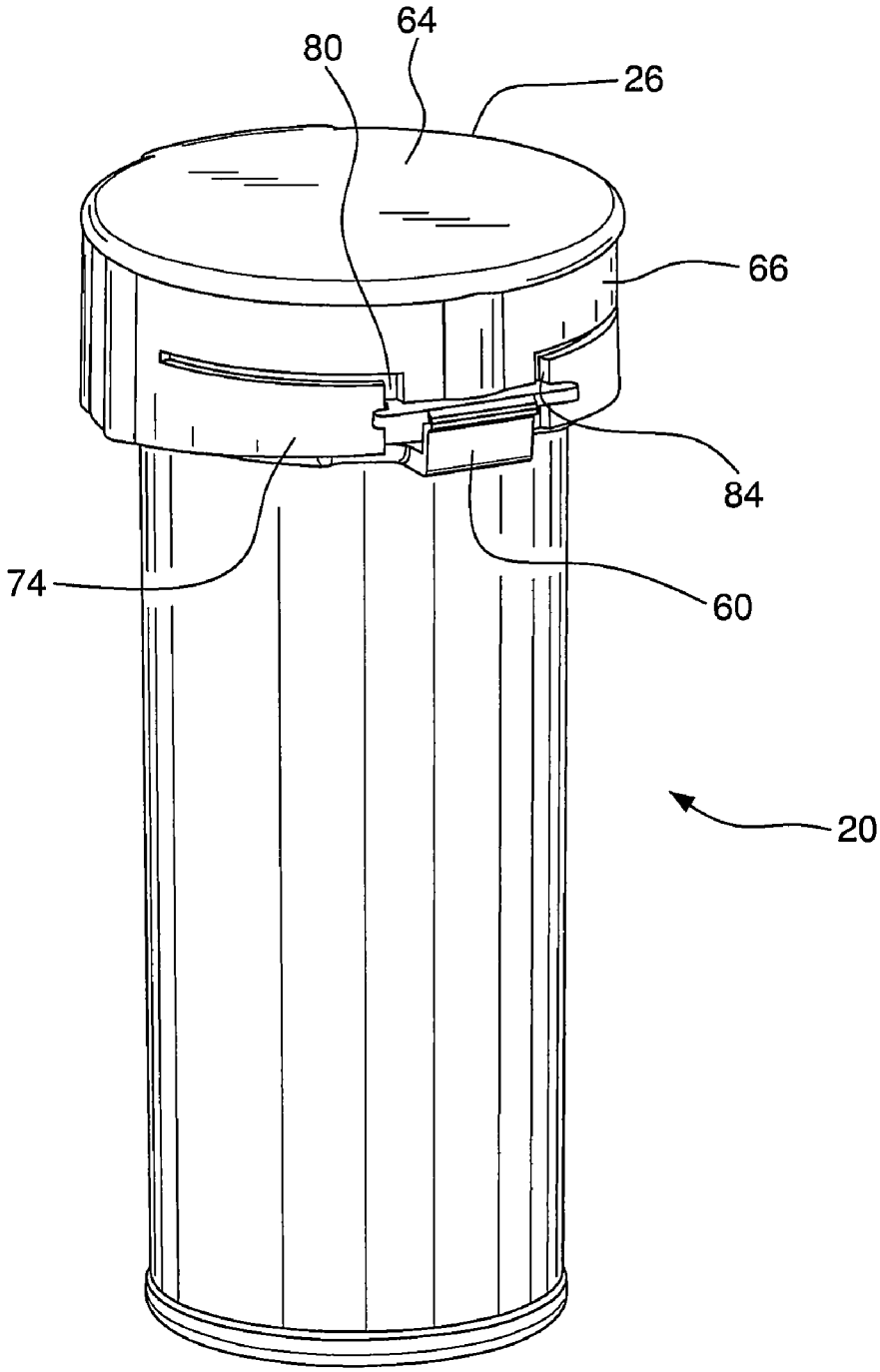
FIG. 3 is a rear perspective view of the embodiment of FIG. 1, showing the hinge and associated elements.
Figure 6:
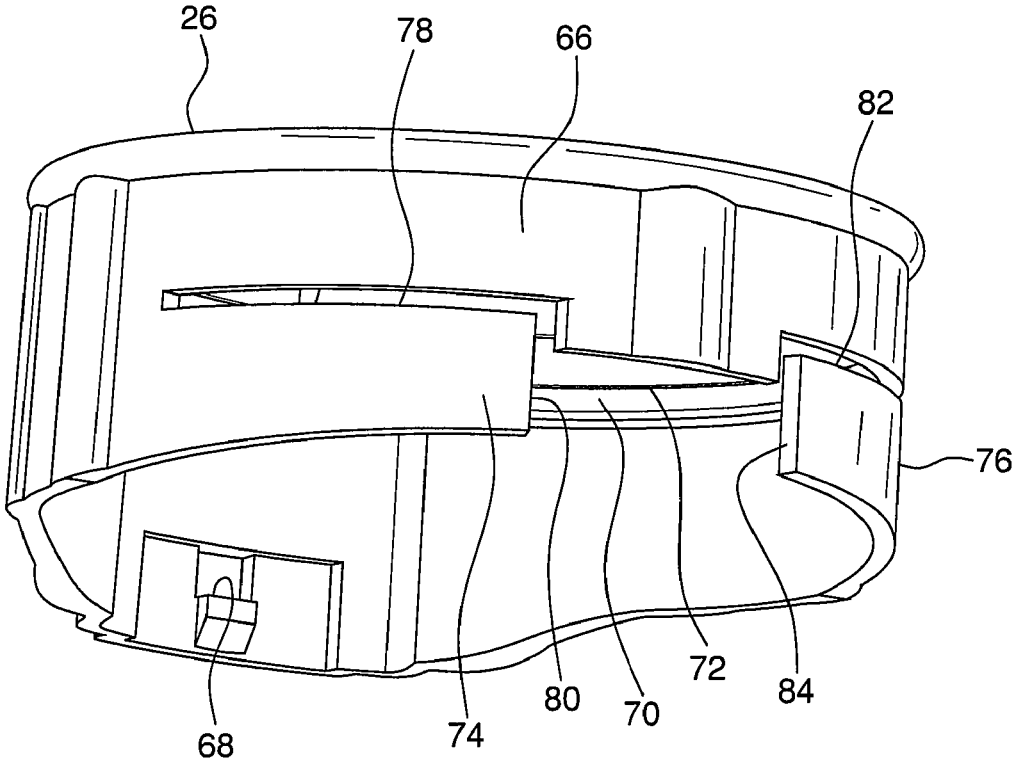
FIG. 6 is an isolated perspective view of the lock of the embodiment of FIG. 1, shown generally from the rear.

The parts of the lock 26 are shown particularly in FIGS. 3 and 6. The lock 26 in this embodiment is configured as an outer cap, including a web 64 and a depending skirt 66, that covers the lift-off cap 24 in use and prevents the cap 24 from being unseated while the lock 26 is engaged. The lock 26, at a minimum, includes an upward-facing abutment 68, adapted and normally biased to engage the downward facing abutment 40 of the vessel. "Upward facing" simply means that the abutment 68 does not face horizontally or downward, when the rim 32 is generally horizontal and positioned at the top and the lock 26 is in its locking position, shown here in FIGS. 1-3. The abutment 40 can face directly upward or obliquely upward.

Returning to FIG. 6, the illustrated embodiment includes additional features. A pivot flange 70 is provided extending circumferentially around at least a portion of the skirt 66, defining above it a pivot groove 72. At least one spring, in this embodiment a pair of leaf springs 74 and 76, is provided. The spring 74 is formed in this embodiment by providing a circumferentially extending slot 78 in the skirt 66, relieving part of the periphery of the spring 74 so it is free to flex unconstrained by the relative stiffness of the remainder of the skirt 66. The spring 74 is integrally formed with the skirt 66, in this embodiment, and has a hinge abutment 80. The spring 76 is similarly defined in part by the slot 82 and has a hinge abutment 84. In this embodiment, the interior of the skirt 66 also has a thumb tab recess.

Referring to FIGS. 5 and 6, the lock 26 and cap 24 are assembled by snapping the pivot flange 54 of the cap 24 (FIG. 5) into the pivot groove 72 of the lock 26 (FIG. 6) so the pivot flange 70 of the lock 26 is received in the pivot groove 58 of the cap. A similar result can be obtained by providing a flange or bead of the web 46 extending radially outside the skirt 48 of the cap, to receive the pivot groove 72. As a result, the lock 26 is captured on and rotatable on the cap 24, in this embodiment. The lock 26 is rotatable with respect to the cap 24 about an axis that is generally perpendicular to the rim 32 when the cap 24 is seated on the rim 32. This capturing feature prevents the lock 26 from being easily lifted away from the cap 24.

When the cap 24 and lock 26 are assembled for normal use, the downward facing abutment 40 of the vessel is circumferentially aligned with the upward facing abutment 68 of the lock 26. Additionally, the hinge abutments 80 and 84 (FIG. 6) abut the spring abutments 61 and 62 (FIG. 4), as shown best in FIG. 3. The bias springs 74 and 76, when relaxed, thus normally bias the abutments 40 and 68 into engagement, locking the container 20.

Figure 7:
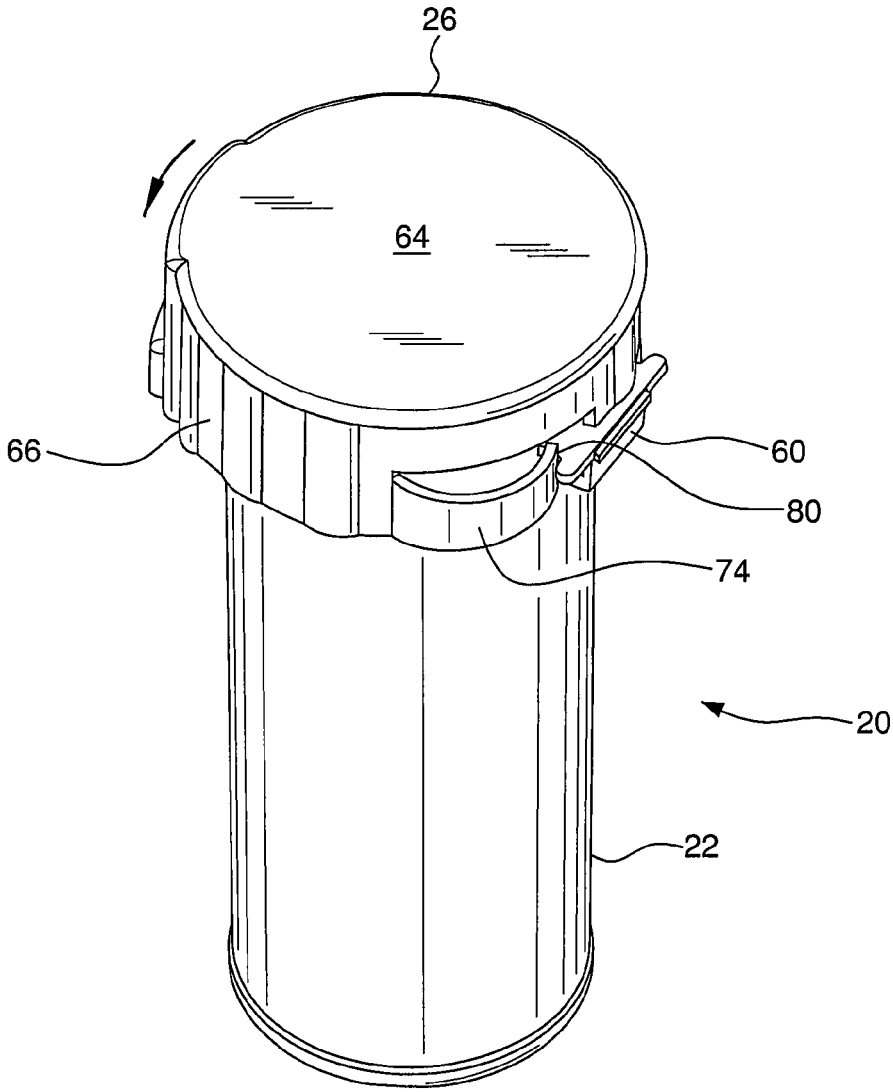
FIG. 7 is a view similar to FIG. 3, showing the lock rotated against its bias.

The abutments 40 and 68 are disengaged by rotating the lock 26 against the bias exerted by one of the springs 74 or 76, displacing the abutment 68 of the lock 26 laterally and permitting the cap 24 to be lifted to open the container 20. This is illustrated by comparing FIGS. 3 and 7. In FIG. 3, the lock 26 is in its rest position, the abutments 40 and 68 are engaged, and the spring 74 is relaxed and remains in line with the skirt 66, so the container 20 is locked. In FIG. 7, the lock 26 is turned counterclockwise relative to the vessel 22, bending the spring 74 due to the engagement of the hinge abutment 80 of the spring 74 with the spring abutment 61 of the hinge 60. Urging the lock 26 against its bias bends the spring 74. The abutments 40 and 68 are disengaged, and the cover can be lifted up from the position shown in FIG. 7, while maintaining the displacement of the lock 26, to open the container. The lock 26 can also be turned clockwise relative to the vessel 22, which causes the spring 76 to bend due to the engagement of the hinge abutment 84 of the spring 76 with the spring abutment 62 of the hinge 60. Again, the abutments 40 and 68 are disengaged, and the cover can be lifted up from the vessel.

In an alternate embodiment, only one of the springs 74 or 76 is necessary; the other could be replaced by a fixed abutment that allows the lock 26 to be rotated in only one direction, against the bias of the single spring.

Figure 8:
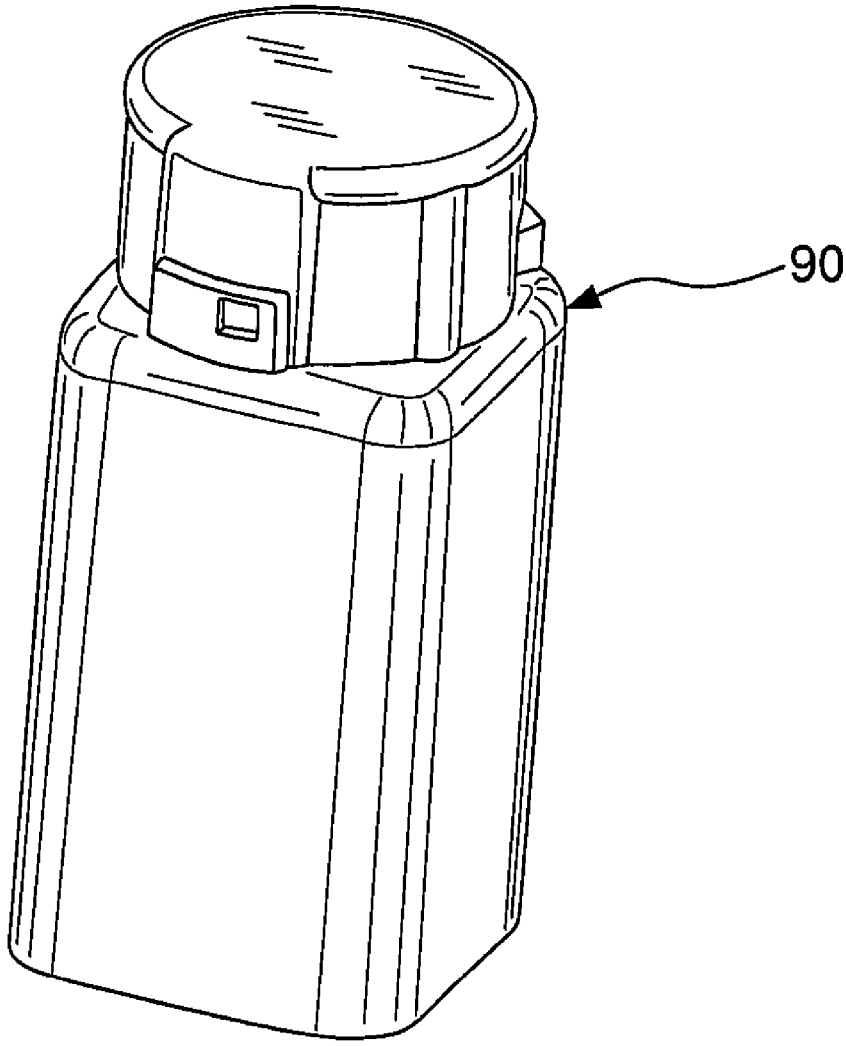
FIG. 8 is a perspective view of another embodiment of the invention.
Figure 9:
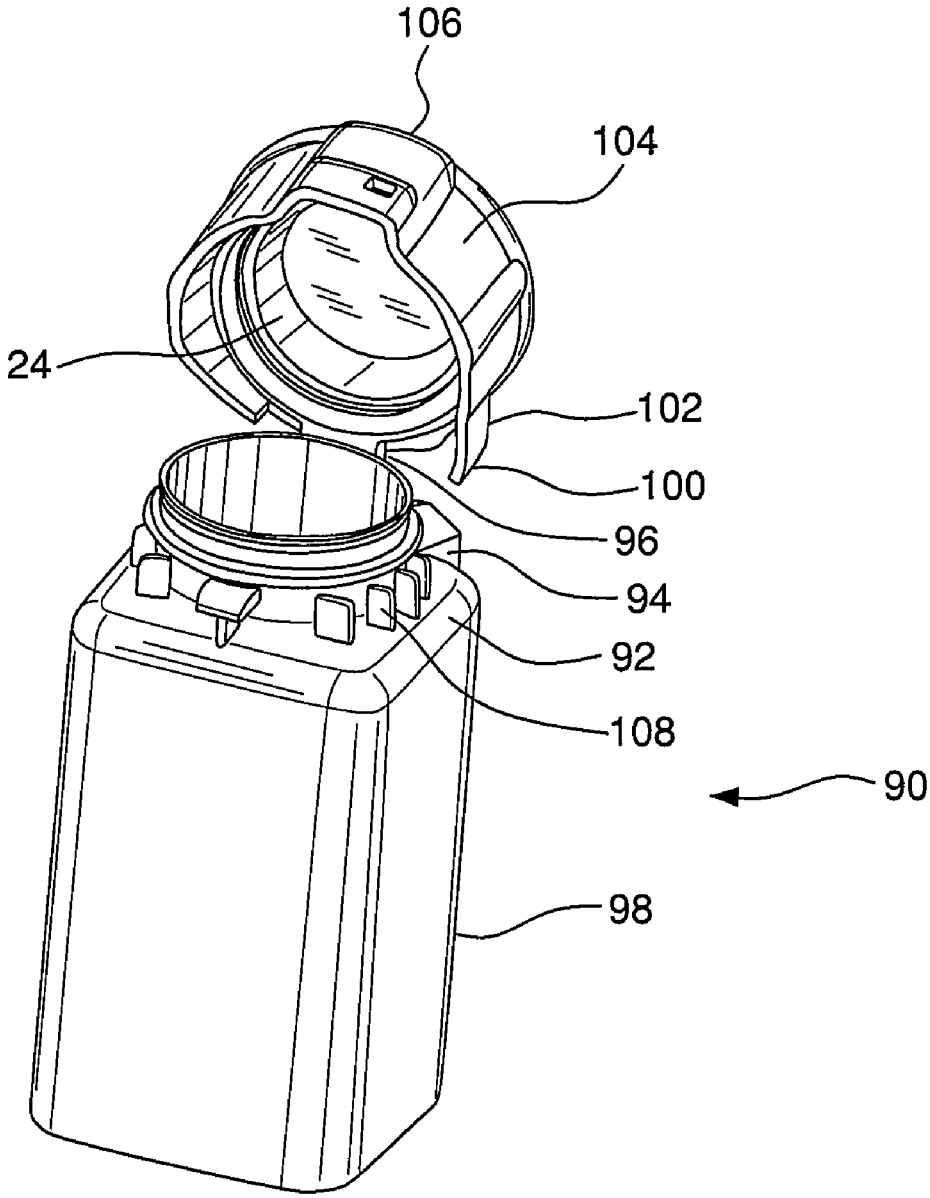
FIG. 9 is a view similar to FIG. 8, but showing the cap unseated and lifted.

FIGS. 8-11 show a second embodiment of a closure system of the present technology, in which a container 90 includes a bottle-shaped vessel 98 having a shoulder 92 and a faceted, approximately square section. The working parts of the container 90 are similar to those of the container 20, except as indicated here. In the embodiment of FIGS. 8-11, as shown in FIG. 9, the spring engaging surface is not a portion of the hinge 96, but rather is an abutment or lug 94 that projects upward from the shoulder 92 of the vessel 98. Also, with reference to FIGS. 9 and 10, the abutment 100 of the spring 102 on the lock 106 is displaced radially outward with respect to the skirt 104 of the lock 106. The abutment 94 is angled, as shown in FIG. 9, such that the abutment 100 optionally can act as a cam surface sliding radially outward along the abutment 94, bending the spring 102 radially outward to generate the necessary bias against rotation. This arrangement exerts leverage on the spring 102.

FIG. 9 also shows reinforcing projections such as 108 to reinforce the skirt 104, which in this embodiment depends below the inner lift-off cap 24.

Figure 10:
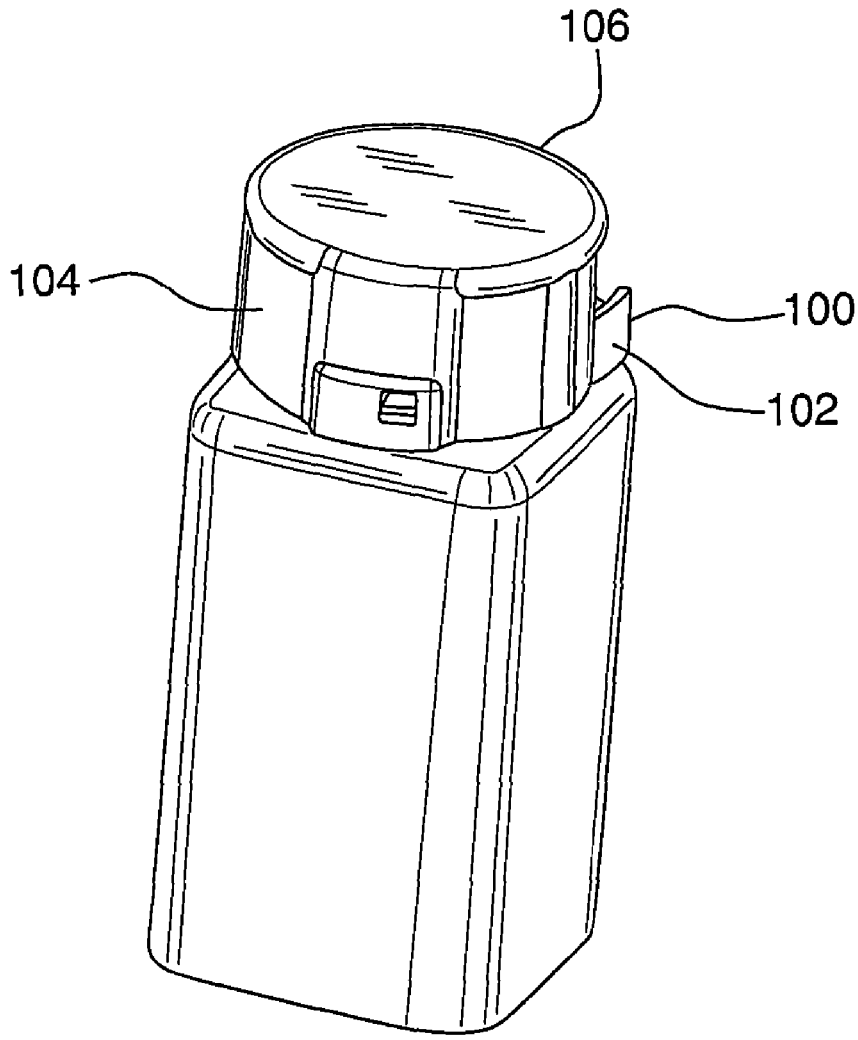
FIG. 10 is a view similar to FIG. 8, but showing the lock rotated, deflecting a leaf spring outward against an abutment.
Figure 11:
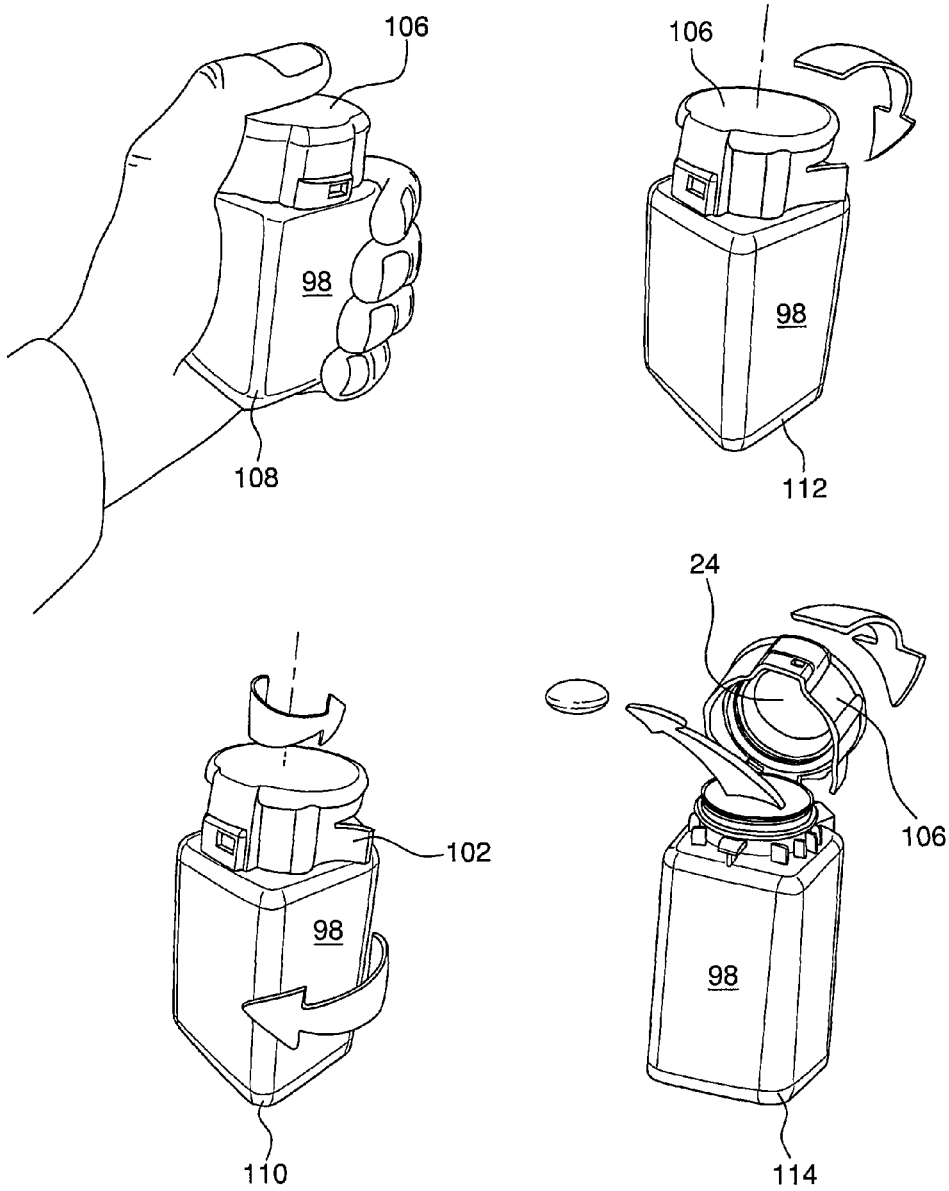
FIG. 11 is a diagrammatic series of views showing how the container can be unlocked and opened, focusing on the embodiment of FIGS. 8-10 but applicable in most respects to the embodiment of FIGS. 1-7 as well.

FIG. 11 shows the necessary steps for opening either embodiment of the container, illustrated respecting the embodiment of FIGS. 8-10. Step 108 shows the user grasping the vessel 98 in one hand. Then the lock 106 is rotated relative to the vessel 98, as shown in step 110. Finally, while maintaining the lock 106 in its displaced position against the bias of the spring 102, the lock 106 and underlying cap is flipped up about its hinge, as shown at 112. The container then opens, as shown in the step 114.

The invention has now been described in such full, clear, concise and exact terms as to enable any person skilled in the art to which it pertains to practice the same. It is to be understood that the foregoing describes preferred embodiments and examples of the invention, and that modifications may be made therein without departing from the spirit or scope of the invention as set forth in the claims.

What is claimed is:

1. A lift-top container comprising:

(a) a vessel comprising a mouth defined by a rim lying substantially in the plane of the mouth and defining an upper portion of the container when upright, the vessel further comprising an exterior portion, and a generally downward-facing abutment projecting laterally from the exterior portion;

(b) a lift-off cap having a seating member sized and configured to seat on the rim, wherein the seating member is a groove and the rim is seated within the groove;

(c) a lock engaging the cap, the lock being rotatable with respect to the cap about an axis generally perpendicular to the rim, the lock comprising an upward-facing abutment normally biased to engage the downward-facing abutment of the vessel, preventing the cap from being lifted off;

the lock being rotatable against the bias to disengage the abutments, permitting the cap to be lifted to open the container;

the lock further comprising a skirt portion surrounding the lift-off cap, and having a bottom edge that extends below the lift-off cap when the lift-off cap is seated on the rim, the lock further comprising at least one spring integrally formed with the skirt portion of the lock.

2. The lift-top container of claim 1, wherein the lift-off cap is joined to the vessel by a hinge.

3. The lift-top container of the claim 1, wherein the rim is beaded.

4. The lift-top container of claim 3, wherein the rim and the groove form a seal.

5. The lift-top container of claim 2, wherein the hinge is provided with an abutment that engages the spring when the lock is rotated, to disengage the downward-facing and upward-facing abutments.

6. The lift-top container of claim 5, wherein the spring is a leaf spring.

7. The lift-top container of claim 1, wherein the vessel comprises a shoulder portion, and the shoulder portion is provided with an upwardly projecting lug that deflects the spring radially outward when the lock is rotated.

8. The lift-top container of claim 5, wherein the lock comprises a first spring and a second spring integrally formed with the skirt portion, and the hinge comprises a first abutment and a second abutment, with the first abutment positioned on one side of the hinge and the second abutment positioned on another side of the hinge, whereby the first abutment engages the first spring when the lock is rotated clockwise, and the second abutment engages the second spring when the lock is rotated counter-clockwise.

9. The lift-top container of claim 1, wherein the lift-off cap has a raised surface that defines a circumferential pivot flange, and the lock has a circumferential groove positioned on at least a portion of its interior surface, and wherein the pivot flange of the lift-off cap fits into the circumferential groove on the lock tto engage the lock to the cap.

10. The lift-top container of claim 9, wherein the lift-off cap has a circumferential groove radially outward of the pivot flange, and the lock has a pivot flange extending circumferentially around at least a portion of the interior surface of the lock beneath the pivot groove in the lock, and wherein the pivot flange on the lock is received within the circumferential groove in the lift-off cap.

11. The lift-top container of claim 1, wherein the at least one spring is defined in part by a circumferentially extending slot in the skirt portion.

12. A child-resistant lift-top container comprising:

(a) a vessel comprising a mouth defined by a rim lying substantially in the plane of the mouth and defining an upper portion of the container when upright, the vessel further comprising an exterior portion and a generally downward-facing abutment projecting laterally from the exterior portion;

(b) a lift-off cap having a seating member sized and configured to seat on the rim;

(c) a locking cap having a web portion and a skirt portion that extends downwardly from the web portion, the web portion and the skirt portion defining an interior sized to fit over and engage the lift-off cap, the locking cap being rotatable with respect to the lift-off cap about an axis generally perpendicular to the rim, the locking cap comprising a generally upward-facing abutment normally biased to engage the downward-facing abutment of the vessel, preventing the lift-off cap from being lifted off the rim;

the locking cap being rotatable against the bias to disengage the abutments, permitting the lift-off cap to be lifted to open the container;

the locking cap further comprising at least one spring integrally formed with the skirt portion of the locking cap; and the vessel further comprising at least one spring-engaging surface which engages the spring when the locking cap is rotated.

13. The child-resistant lift-top container of claim 12, wherein the lift-off cap is joined to the vessel by a hinge.

14. The child-resistant lift-top container of claim 13, wherein the spring-engaging surface is on the hinge.

15. The child-resistant lift-top container of claim 12 wherein the spring-engaging surface projects upwardly from the vessel.

16. The child-resistant lift-top container of claim 12, wherein the lift-off cap has a raised portion that defines a pivot flange, and the interior of the locking cap has a groove extending circumferentially around at least a portion of the interior, and the pivot flange engages the groove.

17. The child-resistant lift-top container of claim 12, wherein the at least one spring is defined in part by a circumferentially extending slot in the skirt portion.

18. A lift-top container comprising:

(a) a vessel comprising a mouth defined by a rim lying substantially in the plane of the mouth and defining an upper portion of the container when upright, the vessel further comprising an exterior portion, and a generally downward-facing abutment projecting laterally from the margin exterior portion;

(b) a lift-off cap having a seating member sized and configured to seat on the rim, the lift-off cap being joined to the vessel by a hinge;

(c) a lock engaging the cap, the lock being rotatable with respect to the cap about an axis generally perpendicular to the rim, the lock comprising an upward-facing abutment normally biased to engage the downward-facing abutment of the vessel, preventing the cap from being lifted off;

the lock being rotatable against the bias to disengage the abutments, permitting the cap to be lifted to open the container;

the lock further comprising a skirt portion and at least one spring integrally formed with the skirt portion of the lock; and the hinge having an abutment that engages the spring when the lock is rotated, to disengage the downward-facing and upward-facing abutments.

* * * * *